United States Patent [19]

Trepp

[11] Patent Number: 4,640,667

[45] Date of Patent: Feb. 3, 1987

[54] APPARATUS FOR CONVEYING AND COMPRESSING A GASEOUS MEDIUM

[75] Inventor: Christian Trepp, Seuzach, Switzerland

[73] Assignee: Sulzer Brothers Limited, Winterthur, Switzerland

[21] Appl. No.: 797,639

[22] Filed: Nov. 13, 1985

Related U.S. Application Data

[62] Division of Ser. No. 601,370, Apr. 17, 1984, abandoned.

[30] Foreign Application Priority Data

Apr. 29, 1983 [CH] Switzerland ..... 2339/83

[51] Int. Cl.[4] ..... F04B 19/24; F04B 23/04

[52] U.S. Cl. ..... 417/52; 417/207; 417/244

[58] Field of Search ..... 417/52–54, 417/65, 149, 207–209, 379, 10, 244

[56] References Cited

U.S. PATENT DOCUMENTS

| | | | |
|---|---|---|---|
| 846,302 | 3/1907 | Gobbe | 417/52 |
| 3,087,438 | 4/1963 | Ciesielski | 417/207 |
| 3,180,278 | 4/1965 | Klein | 417/149 X |
| 3,489,335 | 1/1970 | Schuman | 417/207 X |
| 3,767,325 | 10/1973 | Schuman | 417/207 |
| 3,782,859 | 1/1974 | Schuman | 417/207 |
| 3,807,904 | 4/1974 | Schuman | 417/207 |
| 3,827,675 | 8/1974 | Schuman | 417/207 X |
| 3,898,017 | 8/1975 | Mandroian | 417/209 X |
| 3,899,888 | 8/1975 | Schuman | 417/207 X |
| 3,902,263 | 9/1975 | Schuman | 60/517 |
| 4,057,961 | 11/1977 | Payne | 417/10 X |

FOREIGN PATENT DOCUMENTS

| | | | |
|---|---|---|---|
| 859743 | 12/1952 | Fed. Rep. of Germany | 417/52 |
| 285775 | 2/1928 | United Kingdom | 417/52 |
| 802601 | 2/1981 | U.S.S.R. | 417/207 |
| 966290 | 10/1982 | U.S.S.R. | 417/379 |

OTHER PUBLICATIONS

Muller, Ulrich A., *Thermoakustische Gasschwingungen: Definition und Optimierungeines Wirkungsgrades,* Diss. ETH Nr. 7014, 1982, pp. 1, 82 and 110.

*Journal of Physics D,* "Pumping Action from Heat--Driven Oscillations in a Liquid Vapor Column," Band 9, Nr. 10, 1976, pp. 1419–1424.

*Primary Examiner*—Carlton R. Croyle
*Assistant Examiner*—Paul F. Neils
*Attorney, Agent, or Firm*—Kenyon & Kenyon

[57] ABSTRACT

The apparatus for conveying and compressing a gaseous medium utilizes thermoacoustic oscillations. The oscillations are generated in a tubular cavity by means of a heat source or heat sink with the medium to be conveyed being taken in through a check valve on one side while being exhausted after compression through a second check valve on an opposite side. During operation, the heat is supplied to the medium within the tubular cavity to generate thermoacoustic oscillations.

In one embodiment, a plurality of tubes can be disposed in series relative to a common line. Also, the apparatus can be used in combination with a helium liquifying plant.

4 Claims, 4 Drawing Figures

APPARATUS FOR CONVEYING AND COMPRESSING A GASEOUS MEDIUM

This is a division of application Ser. No. 601,370, filed Apr. 17, 1984, now abandoned.

This invention relates to an apparatus and method for conveying and compressing a gaseous medium. More particularly, this invention relates to an apparatus and method for conveying and compressing a gaseous medium by means of thermoacoustic oscillations.

Heretofore, it has been known to generate thermoacoustic oscillations in a gaseous medium. For example, there is a mention on page 1 of Ulrich A. Muller's dissertation "Thermoakustische Gasschwingungen: Definition und Optimierung eines Wirkungsgrades", Diss. ETH Nr. 7014, 1982, of the excitation of laminar gas oscillations in a tube or duct by particular wall temperature distributions. Also, pages 82 and 110 of the dissertation show the configuration of a corresponding simple thermal engine having a piston, the intention being that the piston is set in oscillation by the excitation of gas oscillations, so that the thermal energy supplied to the gas is converted into mechanical work performed by the piston.

However, the device described in this publication is only able to produce a standing gas oscillation or compression. The device cannot convey the gas.

Accordingly, it is an object of the invention to provide an apparatus and method whereby thermoacoustic oscillations can produce not only a standing compression but also conveyance of a gaseous medium.

It is another object of the invention to be able to provide for a low-temperature conveyance of a gaseous medium utilizing thermoacoustic oscillations.

Briefly, the invention provides an apparatus for conveying and compressing a gaseous medium which includes at least one duct-like vessel having a chamber for receiving a gaseous medium, at least one heat exchange means disposed about the vessel for exchanging heat with the gaseous medium in the vessel in order to generate thermoacoustic oscillations therein and a line in communication with the chamber for conveying a gaseous medium into and out of the chamber. In addition, a first shut-off element is disposed in the line upstream of the vessel to permit delivery of a gaseous medium to the line for compression therein while a second shut-off element is disposed in the line downstream of the vessel to permit exhaust of the compressed gaseous medium from the line.

The heat exchange means may be of a type to provide an external source or heat sink for the gaseous medium about or within the vessel.

The shut-off elements provide a simple means of producing a unidirectional and substantially continuous flow of the gaseous medium. In this respect, the shut-off elements can be check valves with the advantage that the conveying line is sealed hermetically. Also, the longitudinal axis of the vessel can extend transversely of the length of the conveying line. This provides an advantage in that the construction can be very short and compact in the conveying direction.

In one embodiment, at least two of the vessels can be connected in series to the conveying line with separate heat exchange means disposed about or within each vessel. This permits the compression ratio to be increased considerably. Further, the two vessels can be interconnected by way of a common shut-off element.

This provides for a very compact construction having relatively few moving parts.

The method of conveying and compressing a gaseous medium comprises the steps of exchanging heat between a gaseous medium in a chamber of a duct-like vessel and a heat exchange medium in order to generate thermoacoustic oscillations in the chamber, drawing a gaseous medium into the chamber from one side in response to the oscillations and compressing and exhausting the gaseous medium from an opposite side of the chamber in response to the oscillations in alternating manner with the drawing in of the gaseous medium from the chamber.

The method is characterized in that a piston-like pumping can be provided in the chamber of the duct-like vessel by the oscillation of the gas column itself. Thus, mechanical pistons with their elaborate drive and with their sealing and friction problems become unnecessary.

Very advantageously, the inflow and outflow of the medium can occur transversely of the direction of the thermoacoustic oscillation. This insures that the thermoacoustic oscillation produces an optimal piston-like pumping and that the method can be performed in a compact space.

The thermoacoustic oscillations can be maintained by a continuous supply and removal of heat. The frequency of the thermoacoustic oscillations can then be adjusted optimally over a wide range. In particular, heat can be removed by means of the gaseous medium itself. This greatly simplifies the heat removal.

The method can be particularly used for low-temperature conveyance of a gaseous medium. In such cases, the hermetic construction is particularly advantageous.

The apparatus and method can be particularly used for conveying helium at very low temperatures in a known helium liquifying plant. For example, the apparatus can be used with a helium liquifying plant having a plurality of sequentially disposed heat exchangers for cooling a flow of heated helium and at least one vapor separator for separating helium vapor from the liquid helium downstream of the heat exchangers. In this case, a heat exchanger is disposed in or about the chamber of the conveying and compressing apparatus and is connected in parallel with one of the heat exchangers to receive a flow of heated helium for transfer of heat into the chamber to generate thermoacoustic oscillations therein. In this case, a partial flow of helium can be bled off from a heat exchanger which acts as a precooling stage of the plant. This partial flow serves as a heat source for the chamber in the conveying and compressing apparatus and is returned to the plant after heat has been extracted.

In addition, an inlet line communicates the vapor separator of the plant with the chamber of the conveying and compressing apparatus in order to deliver a flow of helium gas to the chamber. For example, the gaseous helium may be drawn into the chamber from a gas chamber of a final cooling stage of the plant. Compression of the gas can then be carried out at very low temperatures within the chamber with a consequent considerable reduction in heat exchanger costs and a corresponding improvement in efficiency.

A suitable outlet line also communicates the chamber, for example with one of the heat exchangers of the plant in order to deliver a flow of heated and compressed helium thereto for example in heat exchange relation to the flow of heated helium.

These and other objects and advantages of the invention will become more apparent from the following detailed description taken in conjunction with the accompanying drawings wherein.

Figure 3:
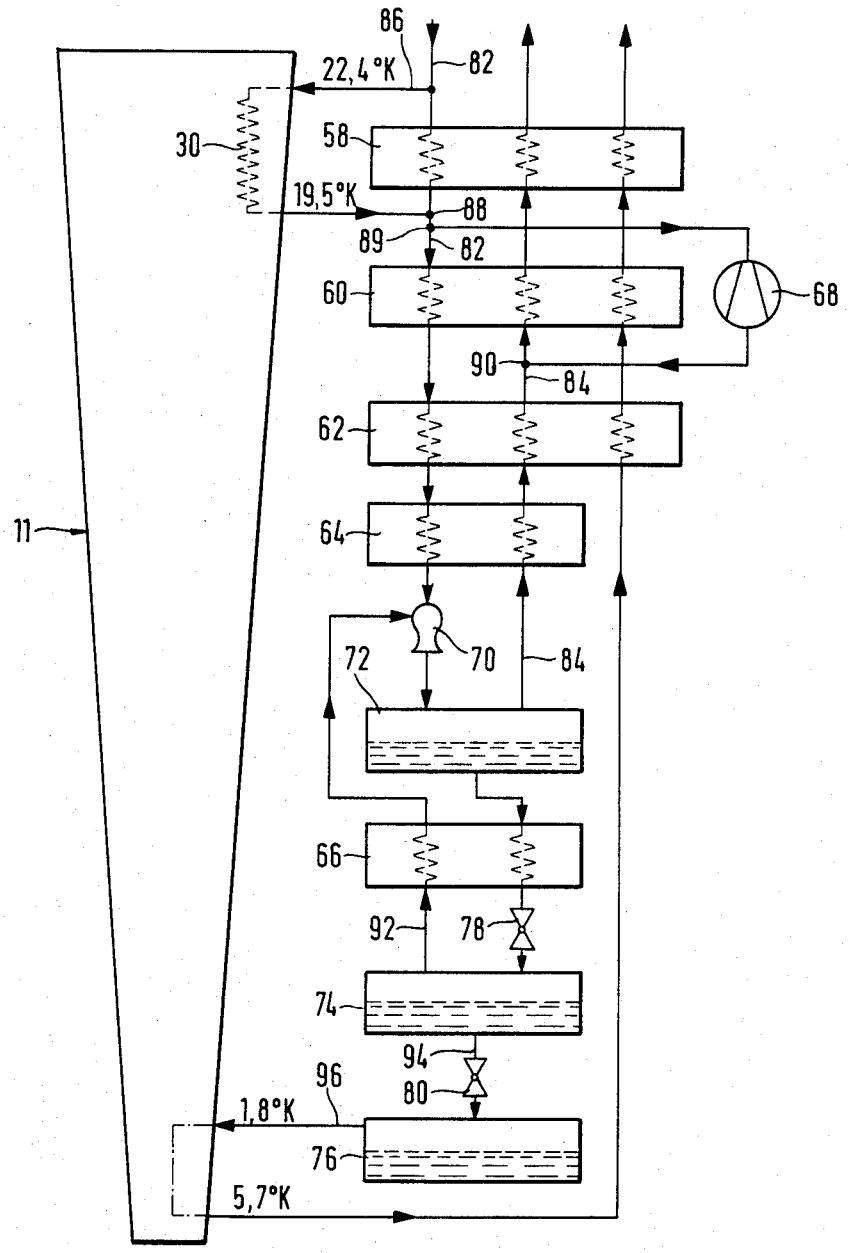
Figure 4:
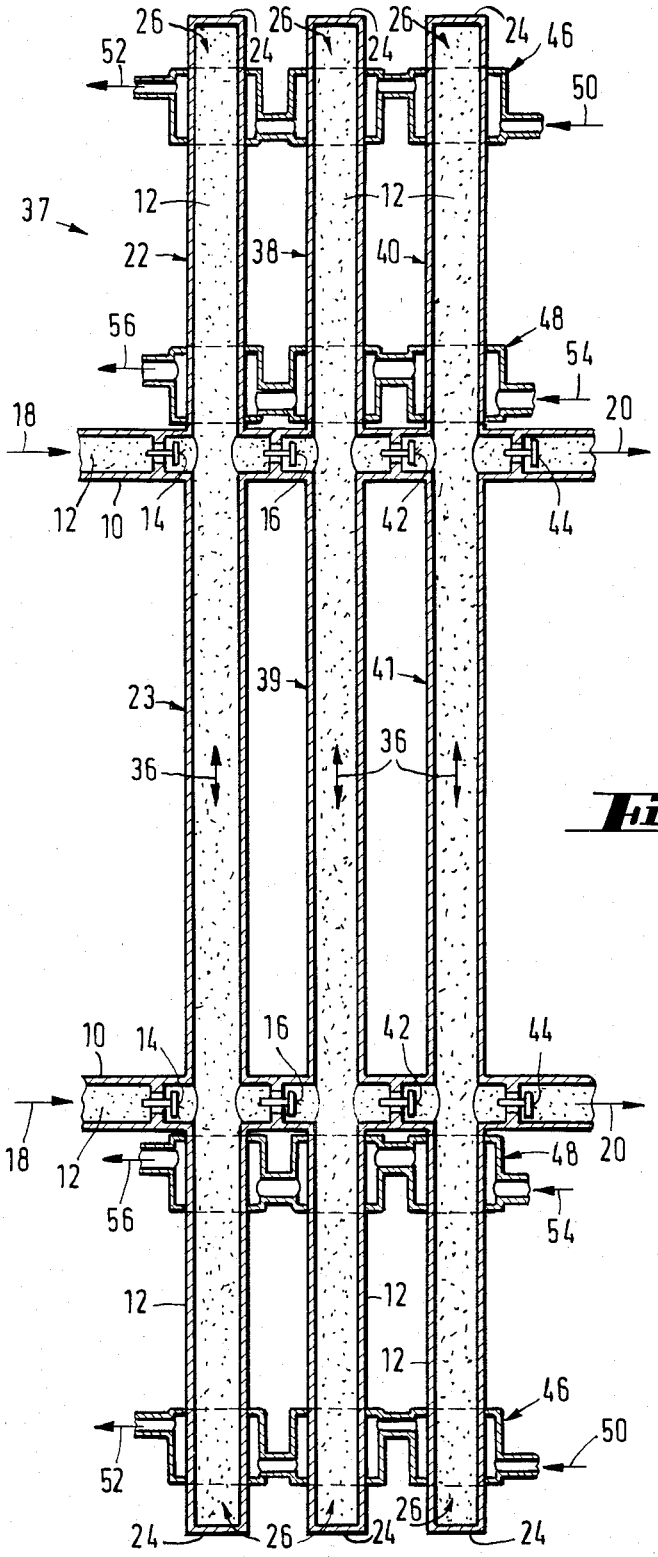

FIG. 3 diagrammatically illustrates an apparatus of the invention employed with a helium liquifying plant in accordance with the invention; and FIG. 4 illustrates a further modified multi-stage apparatus in accordance with the invention.

Figure 1:
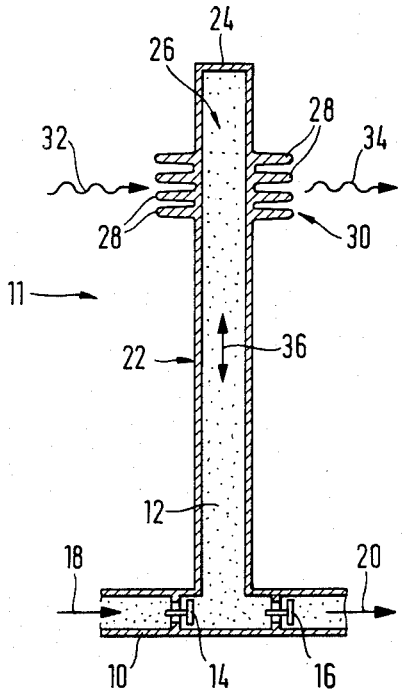
FIG. 1 illustrates a longitudinal cross-sectional view of one embodiment of an apparatus constructed in accordance with the invention.

Referring to FIG. 1, the apparatus 11 for conveying and compressing a gaseous medium includes a line 10 for conveying a gaseous medium 12 therethrough. In addition, a pair of shut-off elements in the form of check valves 14, 16 are disposed in the line 10. These valves 14, 16 can only open in the main direction of flow of the medium 12 as indicated by the arrows 18, 20 but not in the opposite direction.

Further, the apparatus 11 has a duct-like vessel or tube 22 which is connected to the line 10 and has a substantially cylindrical chamber or cavity 26 for receiving the gaseous medium 12 from the line 10. As indicated, the tube 22 is disposed between the valves 14, 16 and is disposed transverse to the axis of the line 10. Further, the tube 22 is closed at the top end, as viewed, by a wall 24.

At least one heat exchange means 30 is disposed about the tube 22 for exchanging heat with the gaseous medium 12 in the chamber 26 in order to generate thermoacoustic oscillations therein. As indicated, the heat exchange means 30 includes a plurality of flanges 28 which are formed on the top part of the tube 22.

In order to convey and compress a gaseous medium 12, such as air, it will be assumed that the medium is supplied and removed in the direction indicated by the arrows 18, 20. In addition, it is assumed that heating of the flanges 28 on the tube 22 occurs by passing hot air over the flanges 28 in the directions indicated by the arrows 32, 34. When a heat exchange takes place between the air in the tube 22 and the hot air flowing over the flanges 28, thermoacoustic oscillations are generated in the chamber 26. These oscillations are operative in the directions indicated by the double arrow 36 in FIG. 1 within the air column in the cavity 26. During an upwards oscillation, air is drawn in through the check valve 14 in the direction 18 while the valve 16 remains closed. During a downwards oscillation, the air in the chamber 26 is correspondingly compressed and conveyed outwards through the valve 16 in the direction indicated by the arrow 20 while the valve 14 remains closed. The air which is thus conveyed serves as a heat sink. The heat energy supplied by the hot air flow (32, 34) is therefore removed directly in the direction indicated by the arrow 20 by the outgoing compressed air.

Of note, FIG. 1 indicates that the drawing in and exhaust of the air 12 occurs transversely of the direction of the oscillations 36. Further, the operation of the apparatus 11 is such that there is a continuous supply and removal of heat to the cavity 26 so that the operation of the apparatus 11 occurs continuously.

Figure 2:
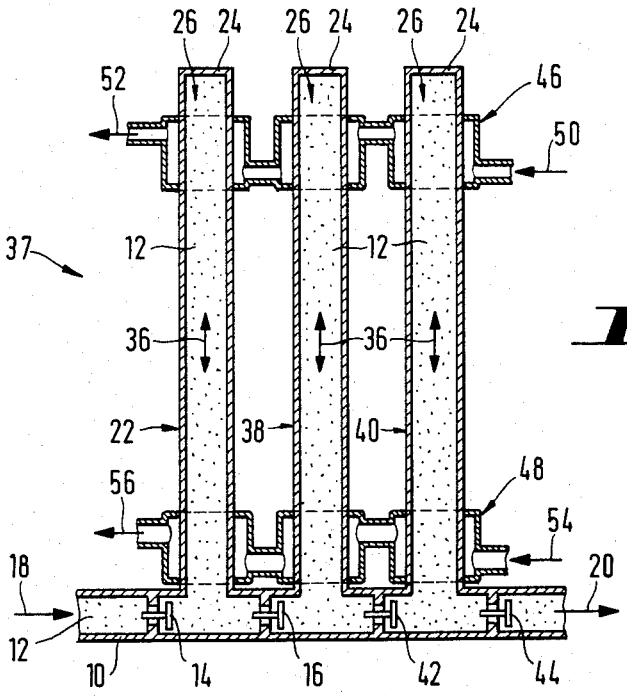
FIG. 2 illustrates a multi-stage apparatus constructed in accordance with the invention.

Referring to FIG. 2, wherein like reference characters indicate like parts as above, the apparatus 37 for conveying and compressing the gaseous medium 12 may include two more tubes 38, 40 following the first tube 22 in series. As indicated, each of the tubes 22, 38, 40 is connected to the line 10 and check valves 14, 16, 42, 44 are disposed in alternating relation to the tubes. For example, the compression stages 22, 38 are interconnected by way of the valve 16 and the compression stages 38, 40 are connected by way of the check valve 42, as a common shut-off element.

In addition, a common heat exchange means in the form of a heating jacket extends around the top parts of the tubes 22, 38, 40 while a further common cooling jacket 48 extends around the bottom parts of the tubes 22, 38, 40.

The operation of the apparatus 37 is similar to the operation of the apparatus 11 described above except that steam is supplied to and removed from the heating jacket 46 as indicated by the arrows 50, 52 while cooling water is supplied to and removed from the cooling jacket 48 as indicated by the arrows 54, 56. In this case, the medium 12 is conveyed without a temperature increase in the direction indicated by the arrow 20.

Referring to FIG. 3, the conveying and compressing apparatus 11 may be used, for example, in combination with a helium cooling or liquifying plant. As illustrated, the plant has a cold part formed of a plurality of sequentially disposed heat exchangers 58, 60, 62, 64, 66 for cooling a flow of heated helium. In addition, the cold part includes an expansion turbine 68, an ejector 70, a plurality of vapor separators 72, 74, 76 which are connected in series and Joule-Thomson valves 78, 80. The separators 72, 74, 76 serve to separate helium vapor from liquid helium downstream of the heat exchangers 58, 60, 62, 64.

As illustrated, a heat exchanger 30 is disposed within the apparatus 11 and is connected in parallel with the first heat exchanger 58 which acts as a precooler for the flow of helium. The heat exchanger 30 receives a flow of heated helium for transfer of heat into the chamber (not shown) of the apparatus 11 in order to generate the thermoacoustic oscillations therein. In addition, the apparatus 11 has an inlet line communicating the vapor space of the last vapor separator 76 with the apparatus 11 in order to deliver a flow of helium gas to the apparatus 11 as well as an outlet line communicating the apparatus 11 with the heat exchanger 62 to deliver a flow of heated and compressed helium thereto in heat exchange relation with the flow of heated medium passing therethrough.

When the plant is in operation, a helium input flow 82 which has been precompressed in a warm part (not shown) of the plant and which has an input temperature of 22.4° K. and an input pressure of 16 bar is passed through the heat exchangers 58, 60, 62, 64 and supplied at an output temperature and at the same output pressure through the ejector 70 to the separator 72, the temperature being 4.2° K. and the pressure 1 bar.

A partial flow 86 of helium is derived from the flow 82, passes through the heat exchanger 30 in the apparatus 11, for use therein as a heat source, and returns to the flow 82 at a place 88 with a temperature of 19.5° K. A position 89 in the flow downstream of place 88 communicates by way of the expansion turbine 68 with the helium flow 84 at junction 90 where the temperature is 8° K. and the pressure 1 bar.

A flow of liquid helium from the separator 72 is cooled in the heat exchanger 66 to a temperature of 4.9° K., expanded by way of the valve 78 and supplied at a temperature of 3.2° K. to the separator 74. A partial flow 92 of helium passes from the separator 74 through the heat exchanger 66 to be supplied to the ejector 70 at a temperature of 4.1° K.

The helium flow 94 in issuing from the separator 74 is further expanded through the Joule-Thomson valve 80 and reaches the separator 76 at the final temperature of 1.8° K. at a pressure of 0.016 bar.

From the separator 76, the gaseous output flow 96 of helium is conveyed through the apparatus 11 and compressed with simultaneous heating, whereafter the flow has a temperature of 5.7° K. and a pressure of 0.1 bar. The compression ratio is therefore approximately 6:1. The flow 96 is then heated by the exchangers 62, 60 and 58 to a temperature 21° K. and returned to the warm section of the plant.

Referring to FIG. 4, wherein like reference characters indicate like parts as above, a pair of apparati 37 of the type shown in FIG. 2 may be interconnected by way of tubes 23, 39, 41 so that the amplitude of the oscillation indicated by the double arrow 36 is increased while space is used very efficiently. The operation of the structure is as described above with respect to the apparatus of FIG. 2. As shown, the tubes 23, 39, 41 are connected across the lines 10 and are coaxial with the respective tubes 22, 38, 40.

The invention thus provides an apparatus and method for conveying and compressing a gaseous medium by means of thermoacoustic oscillations without the need for mechanical devices such as pistons.

What is claimed is:

1. In combination a pair of apparati for conveying and compressing a gaseous medium, each apparatus comprising a line for conveying a gaseous medium, a plurality of vessels connected in series to said line, each vessel having a chamber in communication with said line for receiving gaseous medium, heat exchange means disposed about each said vessel for exchanging heat with a gaseous medium in said respective vessel to generate thermoacoustic oscillations therein, and check valves in said line about each said vessel for conveying a compressed gaseous medium through said line in a downstream direction; and a plurality of tubes connected to and between respective vessels of each apparatus to increase the amplitude of oscillation therein.

2. An apparatus for conveying an compressing a gaseous medium comprising a first line for conveying a gaseous medium therethrough;

at least two duct-like vessels connected to said line in series, each vessel having a chamber in communication with said line for receiving gaseous medium;

at least one heat exchanger means disposed about each vessel for exchanging heat with a gaseous medium therein to generate thermoacoustic oscillations therein;

a first shutoff element in said line upstream of said vessels to permit delivery of a gaseous medium to said line for compression therein;

a second shutoff element in said line between said vessels to permit a flow of compressed gaseous medium through said line in a downstream direction;

a third shutoff element in said line downstream of said vessels to permit exhaust of the compressed gaseous medium from said line;

a second line for conveying a gaseous medium therethrough;

at least two duct-like vessels connected to said second line in series and having a chamber in communication with said second line;

heat exchange means about each vessel connected to said second line for exchanging heat with a gaseous medium therein to generate thermoacoustic oscillations;

a plurality of shutoff elements in said second line in alternating manner with said vessels; and at least one tube connecting at least one vessel connected to said first line to a vessel connected to said second line.

3. An apparatus as set forth in claim 2 wherein each shutoff element is a check valve.

4. An apparatus as set forth in claim 3 wherein each said vessel has a longitudinal axis transverse to said lines.

* * * * *